US008905188B2

(12) United States Patent
Park

(10) Patent No.: US 8,905,188 B2
(45) Date of Patent: Dec. 9, 2014

(54) MUFFLER FOR MOTOR VEHICLE

(71) Applicant: Hyundai Motor Company, Seoul (KR)

(72) Inventor: Ki-Chul Park, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/024,966

(22) Filed: Sep. 12, 2013

(65) Prior Publication Data

US 2014/0144721 A1 May 29, 2014

(30) Foreign Application Priority Data

Nov. 23, 2012 (KR) ..... 10-2012-0133822

(51) Int. Cl.

| | |
|---|---|
| ***F01N 1/02*** | (2006.01) |
| ***F01N 1/08*** | (2006.01) |
| ***F01N 13/18*** | (2010.01) |
| *F01N 1/00* | (2006.01) |
| *F01N 13/00* | (2010.01) |

(52) U.S. Cl.

CPC ..... *F01N 13/1888* (2013.01); *F01N 13/00* (2013.01); *F01N 2470/02* (2013.01); *F01N 2490/02* (2013.01); *F01N 2490/06* (2013.01); *F01N 2490/15* (2013.01)

USPC ..... 181/268; 181/271; 181/272; 181/277; 181/282; 181/241; 181/243

(58) Field of Classification Search

CPC . F01N 13/18; F01N 13/1838; F01N 13/1888; F01N 13/1894; F01N 13/1855

USPC ..... 181/268, 269, 271, 272, 275, 277, 281, 181/282, 241, 243

See application file for complete search history.

(56) References Cited

U.S. PATENT DOCUMENTS

| | | | | | |
|---|---|---|---|---|---|
| 1,353,863 | A | * | 9/1920 | Taber | 181/282 |
| 2,382,159 | A | * | 8/1945 | Klemm | 181/241 |
| 3,042,138 | A | * | 7/1962 | Reinert | 181/241 |
| 3,080,940 | A | * | 3/1963 | Jobson | 181/282 |
| 3,145,800 | A | * | 8/1964 | Marx | 181/241 |
| 3,200,902 | A | * | 8/1965 | Jones | 181/243 |
| 3,838,749 | A | * | 10/1974 | Johnson | 181/268 |
| 3,903,987 | A | * | 9/1975 | Brown et al. | 181/282 |
| 4,109,751 | A | * | 8/1978 | Kabele | 181/247 |
| 4,132,286 | A | * | 1/1979 | Hasui et al. | 181/265 |
| 4,381,045 | A | * | 4/1983 | Buchwalder | 181/265 |
| 4,589,516 | A | * | 5/1986 | Inoue et al. | 181/256 |
| 4,628,689 | A | * | 12/1986 | Jourdan | 60/295 |

(Continued)

FOREIGN PATENT DOCUMENTS

| | | | | |
|---|---|---|---|---|
| GB | 989345 | * | 4/1965 | |
| JP | 57183513 A | * | 11/1982 | F01N 7/18 |

(Continued)

*Primary Examiner* — Edgardo San Martin

(74) *Attorney, Agent, or Firm* — Edwards Wildman Palmer LLP; Peter F. Corless

(57) ABSTRACT

A muffler for a vehicle is provided, including: a muffler housing having a first housing body and a second housing body that are divided in two parts and form an internal space with an inlet opening and an outlet opening when combined; and an internal structure inserted and forced into the internal space of the muffler housing to be detachable from the muffler housing, and allowing an exhaust gas discharged from an engine to flow into the internal space and to be discharged out of the muffler housing through a predetermined path.

14 Claims, 4 Drawing Sheets

(56) References Cited

U.S. PATENT DOCUMENTS

| | | | | |
|---|---|---|---|---|
| 4,673,058 | A * | 6/1987 | Roberts et al. | 181/266 |
| 4,756,383 | A * | 7/1988 | Sterrett | 181/243 |
| 4,953,660 | A * | 9/1990 | Jewell et al. | 181/282 |
| 5,340,952 | A * | 8/1994 | Takiguchi | 181/282 |
| 5,475,189 | A * | 12/1995 | Field et al. | 181/241 |
| 5,633,482 | A * | 5/1997 | Erion et al. | 181/282 |
| 6,431,311 | B1 * | 8/2002 | Brown et al. | 181/282 |
| 6,457,551 | B1 * | 10/2002 | Chang | 181/243 |
| 6,796,403 | B1 * | 9/2004 | Laughlin | 181/279 |
| 7,669,694 | B2 * | 3/2010 | Seon | 181/269 |
| 7,712,578 | B2 * | 5/2010 | Han | 181/272 |
| 7,878,300 | B2 * | 2/2011 | Sammut et al. | 181/249 |
| 7,913,811 | B2 * | 3/2011 | Andre et al. | 181/282 |
| 8,418,805 | B1 * | 4/2013 | Han | 181/264 |
| 8,424,636 | B2 * | 4/2013 | Jones et al. | 181/246 |
| 2002/0066619 | A1 * | 6/2002 | Collmer et al. | 181/251 |
| 2006/0124384 | A1 * | 6/2006 | Tary et al. | 181/243 |
| 2006/0266580 | A1 * | 11/2006 | Seiler | 181/268 |
| 2009/0107760 | A1 * | 4/2009 | Sammut | 181/241 |
| 2013/0153329 | A1 * | 6/2013 | Bischel et al. | 181/228 |

FOREIGN PATENT DOCUMENTS

| | | | |
|---|---|---|---|
| JP | 58-25613 | U | 8/1983 |
| JP | 63-83418 | U | 6/1988 |
| JP | 06-017637 | | 1/1994 |
| JP | 2001317352 | A | 11/2001 |
| KR | 10-0159481 | B1 | 8/1998 |
| KR | 10-2010-0068523 | | 6/2010 |

* cited by examiner

MUFFLER FOR MOTOR VEHICLE

CROSS-REFERENCE TO RELATED APPLICATION

This application claims under 35 U.S.C. §119(a) priority to and the benefit of Korean Patent Application No. 10-2012-0133822 filed in the Korean Intellectual Property Office on Nov. 23, 2012, the entire contents of which are incorporated herein by reference.

BACKGROUND (a) Field of the Invention

The present invention relates to a muffler for a vehicle, more particularly, a muffler which can be conveniently mounted and can reduce exhaust noise.

(b) Description of the Related Art

In general, a muffler that can attenuate exhaust noise is disposed in an exhaust line, which guides an exhaust gas to the rear of a vehicle, as part of the exhaust system for discharging the exhaust gas generated from the engine in the vehicle.

Conventionally, a muffler reduces exhaust noise by decreasing the temperature and pressure of the exhaust gas discharged from an engine, where the muffler may include a muffler housing that forms a chamber with a predetermined volume therein, one or more baffles that are disposed in the housing to divide the chamber into one or more chambers, and a connection pipe that is mounted and supported through the baffles and connects specific chambers in the chambers.

Further, the muffler typically includes an exhaust gas inflow pipe through which the exhaust gas discharged from the engine flows into the muffler housing, an exhaust gas outflow pipe through which the exhaust gas with the pressure, temperature, and noise reduced through a predetermined exhaust path in the muffler housing is discharged out of the muffler housing, and end caps that seal the muffler housing by closing an inlet opening and an outlet opening formed at the muffler housing.

Conventionally the noise due to the exhaust gas discharged from the engine and flowing in the muffler housing through the exhaust gas inflow pipe is attenuated and reduced by interference of sound waves, reduction of pressure variation, absorption of noise, and reduction of exhaust temperature while the exhaust gas flows through a predetermined exhaust path in the muffler housing.

According to the structure of the muffler as described above, the parts are integrally formed, such that it is difficult to separate or change the muffler, and to tune the exhaust noise in a manner desirable to a customer of the vehicle. Instead, it is necessary to replace the entire muffler when the muffler is corroded or damaged. It would be desirable to provide a muffler that is constructed such that the muffler can be separated or changed, or modified in a manner that the exhaust noise can be tuned as desired.

The above information disclosed in this Background section is only for enhancement of understanding of the background of the invention and therefore it may contain information that does not form the prior art that is already known in this country to a person of ordinary skill in the art.

SUMMARY

The present invention has been made in an effort to provide a muffler for a vehicle having advantages of being able to improve convenience of assembly, maintenance, and tuning, and also to improve NVH performance of a vehicle by effectively reducing exhaust noise of an exhaust gas.

An exemplary embodiment of the present invention provides a muffler for a vehicle, which may include: a muffler housing having a first housing body and a second housing body that are divided in two parts and form a predetermined-sized internal space with an inlet opening and an outlet opening when combined; and an internal structure inserted and forced into the internal space of the muffler housing to be detachable from the muffler housing, and allowing an exhaust gas discharged from an engine to flow into the internal space and to be discharged out of the muffler housing through a predetermined path.

The internal structure includes one or more baffles positioned within the internal space of the muffler housing and dividing the internal space into one or more chambers.

The internal structure may further include an exhaust gas inflow pipe that allows the exhaust gas to flow into the internal space and is fitted through the baffles such that a position of the exhaust gas inflow pipe is adjustable, an exhaust gas outflow pipe that allows the exhaust gas to flow out of the muffler housing from the internal space and is fitted through the baffles such that a position of the exhaust gas outflow pipe is adjustable, and a connection pipe that guides the exhaust gas discharged into the internal space from the exhaust gas intake pipe to the exhaust gas outflow pipe and is fitted through the baffles such that a position of the connection pipe is adjustable.

The baffles may each include: a baffle plate with one or more connection holes that allow adjacent chambers to communicate with each other; and a baffle plate support where the baffle plate is detachably fastened. The baffle plate support may include a fixing ring and a fixing bolt for fitting and fixing the exhaust gas inflow pipe, the exhaust gas outflow pipe, and the connection pipe. An extension pipe may be connected to the connection pipe by a connector such that a length of the extension pipe is adjustable. The baffles may include a front baffle and a rear baffle that divide the inside of the muffler housing into a front chamber, a middle chamber, and a rear chamber.

The muffler may further include a front end cap and a rear end cap detachably mounted on the muffler housing to seal the muffler housing by closing an inlet opening and an outlet opening of the muffler housing. The exhaust gas inlet opening pipe may protrude outward further than the front end cap, and the exhaust gas outflow pipe protrudes outward further than the rear end cap.

The exhaust gas inflow pipe may be fitted sequentially through the front end cap, the front baffle, and the rear baffle, and the exhaust gas outflow pipe may be fitted sequentially through the rear end cap, the rear baffle, and the front baffle.

The first housing body may include: a first body panel curved with one or more continuous and stepped curvatures; and a first engaging flange protruding at both edges in the height direction of the first body panel, perpendicular to the first body panel, and having one or more fastening holes. Further, the second housing body may include: a second body panel curved with one or more continuous and stepped curvatures; and a third engaging flange protruding at both edges in the height direction of the second body panel, perpendicular to the second body panel, having one or more fastening holes, and fastened to the first engaging flange in contact with the first engaging flange.

The first housing body may further include a second engaging flange curved in the same shape as that of the first body panel at both edges in the longitudinal direction of the first body panel, and having one or more fastening holes. Further, the second housing body may further include a fourth engaging flange curved in the same shape as that of the second body panel at both edges in the longitudinal direction of the second body panel, and having one or more fastening holes. Additionally, the front end cap and the rear end cap have cap flanges fastened to the second engaging flange and the fourth engaging flange, respectively.

The first housing body may further include: first guide protrusions longitudinally protruding from both ends of the second engaging flange, with a height smaller than the height of the first engaging flange from the bottoms of the ends, at the lower portion of the second engaging flange; and first engaging grooves having an L-shaped cross-section due to the difference in height between the first guide protrusions and the fastening flange. Further, the second housing body may include: second guide protrusions longitudinally protruding from both ends, with a height smaller than the height of the fourth engaging flange from the tops of the ends, and inserted in the first engaging grooves; and second engaging grooves that have an L-shaped cross-section due to the difference in height between the second guide protrusions and the fourth engaging flange, under the second guide protrusions, and in which the first guide protrusions are inserted.

Seating flanges longitudinally protruding outward further than the second engaging flange may be formed at the first body panel, seating flanges protruding outward further than the fourth engaging flange may be formed at the second body panel, and the front end cap and the rear end cap are fitted on the seating flanges.

The ends of the first engaging flange may be disposed inside the first engaging grooves to block one side of each of the first engaging grooves, and the ends of the third engaging flange may be disposed inside the second engaging groove to block one side of each of the second engaging groove.

According to an exemplary embodiment of the present invention, since the internal structure such as one or more baffles, a connection pipe, an exhaust gas inflow pipe, and an exhaust gas outflow pipe can be easily inserted into a muffler housing by sliding, productivity is improved in assembly.

Since the internal structure is inserted in the muffle housing divided into two parts and the muffle housing is assembled by fastening the two parts, the baffles of the internal structure are forced into the muffler housing, such that noise due to an assembly tolerance of the muffler housing can be reduced.

When the muffler housings divided into two parts are fastened, assembly and fastening become easy by the assembly guides of the parts and they are hermetically combined, such that it is possible to effectively prevent leakage of an exhaust gas.

Further, since the exhaust gas inflow pipe and the exhaust gas outflow pipe extend outside the muffler housings through the end cap fastened to the muffler housing, it is possible to replace the exhaust gas pipe with another exhaust pipe or connect another exhaust pipe from the outside of the muffler housing in examination of a corresponding engine or a vehicle and it is possible to effectively and easily prevent leakage of an exhaust gas by means of anti-leakage treatment such as taping the areas between the end caps, the exhaust gas inflow pipe, and the exhaust gas outflow pipe.

It is possible to conveniently use the muffler as a tuning kit in development of a new vehicle and easily tune exhaust noise as a customer wants, in order to satisfy the customer.

In addition, when the parts of the muffler are damaged, for example, by corrosion, it is enough to replace only the damaged parts, such that it is possible to reduce the cost for maintenance due to improved convenience of maintenance, to share parts, use single parts, and/or assemble and dissemble the muffler with simple tools; therefore, workability for assembly and maintenance is improved.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

DETAILED DESCRIPTION OF THE EMBODIMENTS

Exemplary embodiments of the present invention will be described hereafter in detail with reference to the accompanying drawings.

Figure 1:
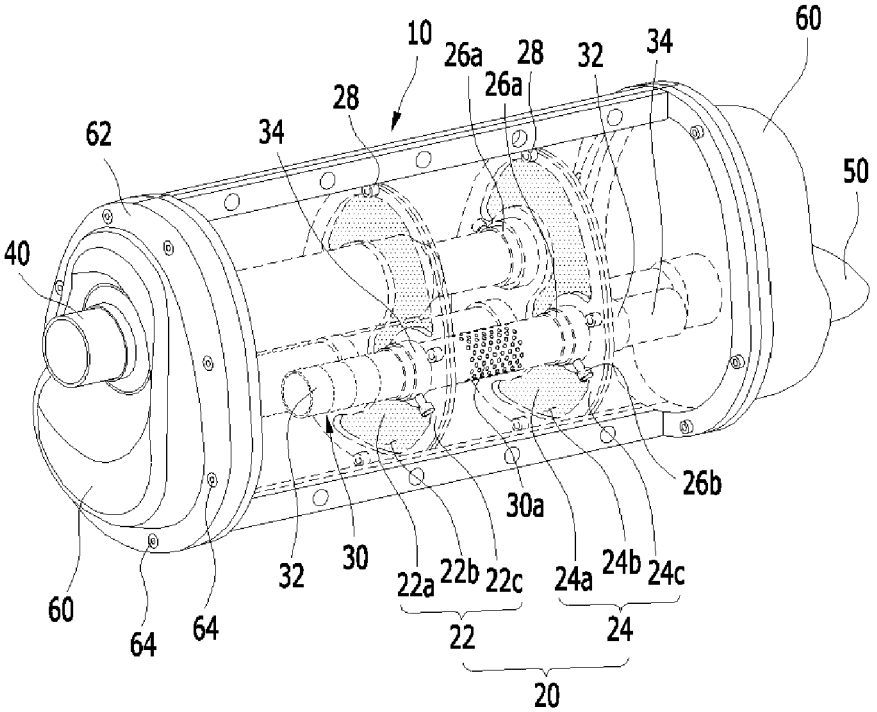
FIG. 1 is a perspective view showing a muffler for a vehicle according to an exemplary embodiment of the present invention.
Figure 2:
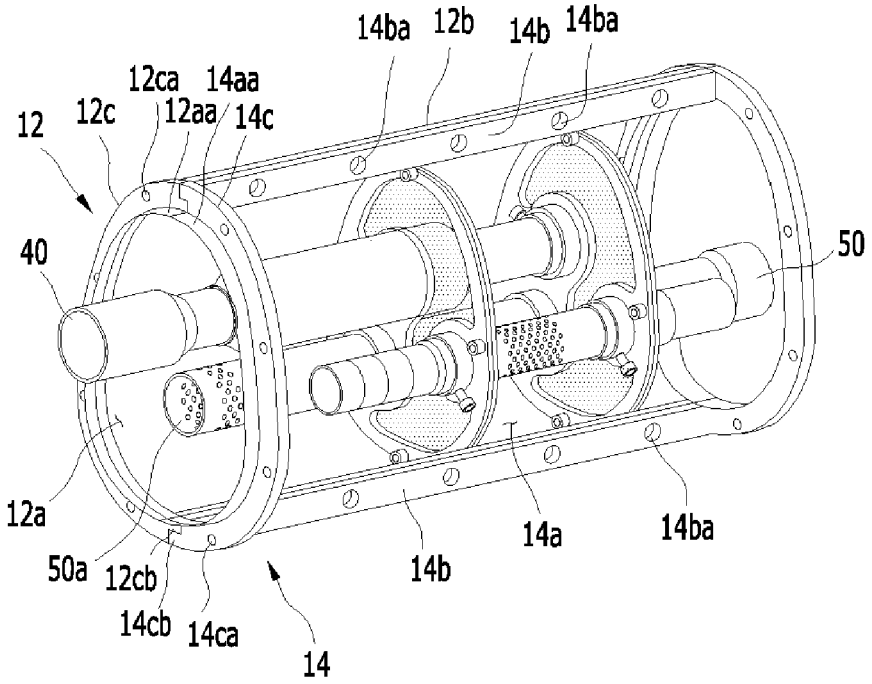
FIG. 2 is a perspective view showing the muffler for a vehicle of FIG. 1, with end caps removed.
Figure 3:
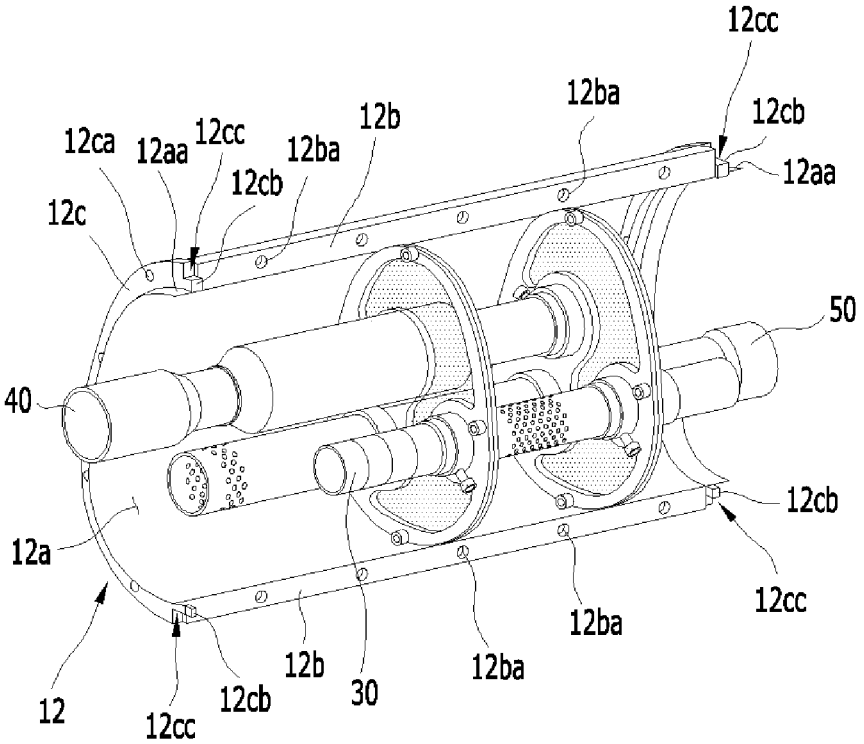
FIG. 3 is a perspective view showing the muffler shown in FIG. 2 with a portion of a muffler housing removed.

Referring to FIGS. 1 to 3, a muffler for a vehicle according to an exemplary embodiment of the present invention includes a muffler housing 10 having a first housing body and a second housing body that are divided in two parts and form a predetermined-sized internal space with an inlet opening and an outlet opening when they are combined.

An internal structure is configured to be inserted and forced into the internal space of the muffler housing to be detachable from the muffler housing. The internal structure allows an exhaust gas discharged from an engine to flow into the internal space and to be discharged out of the muffler housing 10 through a predetermined path.

The internal structure includes one or more baffles 20 positioned within the internal space of the muffler housing and dividing the internal space into one or more chambers.

Further, the internal structure includes an exhaust gas inflow pipe 40 that allows the exhaust gas to flow into the internal space and is fitted through the baffles such that the position of the exhaust gas inflow pipe 40 is adjustable, an exhaust gas outflow pipe 50 that allows the exhaust gas to flow out of the muffler housing from the internal space and is fitted through the baffles such that the position of the exhaust gas outflow pipe 50 is adjustable, and a connection pipe 30 that guides the exhaust gas discharged into the internal space from the exhaust gas inflow pipe to the exhaust gas outflow pipe and is fitted through the baffles such that the position of the connection pipe 30 is adjustable.

A front end cap 60 and a rear end cap 60 are detachably disposed at the inlet opening and the outlet opening, respectively, of the muffler housing 10 to seal the muffler housing 10.

As shown in FIGS. 2-3, the muffler housing 10 includes a first housing body 12 and a second housing body 14 that are divided into symmetric parts. In particular, the first housing body 12 includes a first body panel 12*a* curved with one or more continuous and stepped curvatures, where the first body panel 12*a* may be formed in an arc shape. A first engaging flange 12*b* protrudes at both edges in the height direction of the first body panel 12*a*, perpendicular to the first body panel 12*a*. The first engaging flange 12*b* has a substantially rectangular bar shape. One or more fastening holes 12*ba* preferably are formed through the first engaging flange 12*b* in the length direction of the first engaging flange 12*b* (see FIG. 3). A second engaging flange 12*c* curved in the same shape as that of the first body panel 12*a* is formed at both edges in the longitudinal direction of the first body panel 12*a*. One or more fastening holes 12*ca* preferably are formed through the second engaging flange 12*c* in the length direction of the second engaging flange 12*c* (see FIG. 3).

Figure 4:
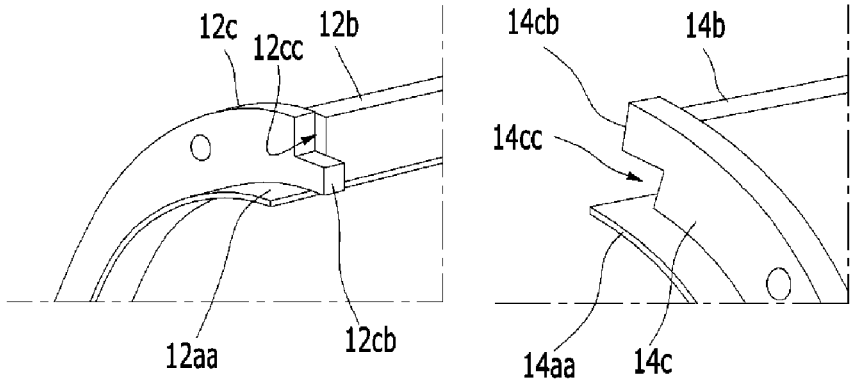
FIG. 4 is an enlarged perspective view showing an assembly guide formed at the muffler housing of FIG. 3.

First guide protrusions 12*cb* longitudinally protrude from both ends of the second engaging flange 12*c*, where the first guide protrusions 12*cb* have a height smaller than the height of the second engaging flange 12*c* from the bottoms of the ends, thus forming first engaging grooves 12*cc* over the first guide protrusions 12*cb*, the first engaging grooves 12*cc* having a substantially L-shaped cross-section due to the difference in height between the first guide protrusions 12*cb* and the second engaging flange 12*c*. The ends of the first fastening flange 12*b* are disposed inside the first engaging grooves 12*cc*, as shown in FIG. 4, and block one side of each of the first engaging grooves 12*cc*.

The second housing body 14 includes a second body panel 14*a* curved with one or more continuous and stepped curvatures, where the second body panel 14*a* may be formed in an arc shape. A third engaging flange 14*b* protrudes at both edges in the height direction of the second body panel 14*a*, perpendicular to the second body panel 14*a*. The third engaging flange 14*b* has a substantially rectangular bar shape. One or more fastening holes 14*ba* preferably are formed through the third engaging flange 14*b* in the length direction of the third engaging flange 14*b* (see FIG. 2). The first engaging flange 12*b* and the third engaging flange 14*b* can be combined by bringing them into contact with thread-fastening bolts through the fastening holes 12*ba* and 14*ba*. A fourth engaging flange 14*c* curved in the same shape as that of the second body panel 14*a* is formed at both edges in the longitudinal direction of the second body panel 14*a*. One or more fastening holes 14*ca* preferably are formed through the fourth engaging flange 14*c* in the length direction of the fourth engaging flange 14*c* (see FIG. 2).

Second guide protrusions 14*cb* longitudinally protrude from both ends of the fourth engaging flange 14*c*. The second guide protrusions 14*cb* are formed to have a height smaller than the height of the fourth engaging flange 14*c* from the tops of the ends, as shown in FIG. 4, thus forming second engaging grooves 14*cc* under the second guide protrusions 14*cb*, the second engaging grooves 14*cc* having a substantially L-shaped cross-section due to the difference in height between the second guide protrusions 14*cb* and the fourth engaging flange 14*c*. Similar to the first engaging grooves 12*cc*, the ends of the third engaging flange 14*b* are disposed inside the second engaging grooves 14*cc* and block one side of each of the second engaging grooves 14*cc*.

When the first housing body 12 and the second housing body 14 are combined through the first engaging flange 12*b* and the third engaging flange 14*b*, the first guide protrusions 12*cb* of the first housing body 12 are inserted in the second engaging grooves 14*cc* of the second housing body 14, and the second guide protrusions 14*cb* of the second housing body 14 are inserted in the first engaging grooves 12*cc* of the first housing body 12, thereby combining the housing bodies.

Therefore, when assembling a muffler housing by fastening the first and second housing bodies that are divided into two parts, it is easy to assemble the muffler because the guide protrusions and the engaging grooves function as assembly guides, and it is possible to prevent leakage of an exhaust gas.

As shown in FIGS. 2-4, seating flanges 12*aa* are provided so as to protrude outwardly further than the second engaging flange 12*c*, the seating flanges 12*aa* being longitudinally formed at the first body panel 12*a*. Similarly, seating flanges 14*aa* protruding outward further than the fourth engaging flange 14*c* are formed at the second body panel 14*a*. The seating flanges 12*aa* and 14*aa* are provided for seating the end caps 60, when the end caps 60 are fitted.

The end cap 60 has a cap flange 62 that is brought into contact with the second engaging flange 12*c* of the first housing body 12 and the fourth engaging flange 14*c* of the second housing body 14. The cap flange 62 is formed in the same shape as that of the combined second engaging flange 12*c* and fourth engaging flange 14*c*. One or more fastening holes 64 preferably are circumferentially formed through the cap flange 62. The cap flanges 62 of the end caps 60 can be fitted and seated on the seating flange 12*aa* of the first housing body 12 and the seating flange 14*aa* of the second housing body 14, respectively, brought into contact with the second engaging flange 12*c* and the fourth engaging flange 14*c*, and then combined by thread-fastening bolts through the fastening holes 64.

As described herein, the baffles 20 are disposed in the muffler housing to divide the chamber formed by the muffler housing 10 into one or more chambers. The outer diameters of the baffles 20 preferably are slightly smaller than the inner diameter of the muffler housing 10. As the second housing body 14 is fastened to the first housing body 12, with the baffles 20 forced into the first housing body 12, the baffles 20 are held in position by the fastening force of the housing bodies.

The baffles 20 preferably include at least a front baffle 22 and a rear baffle 24, and the inside of the muffler housing 10 is divided into a front chamber, a middle chamber, and a rear chamber by the front baffle 22 and the rear baffle 24. The front baffle 22 and the rear baffler 24 respectively include baffle plates 22*b* and 24*b* with one or more connection holes 22*a* and 24*a* that allow the adjacent chambers to communicate with each other, and further including baffle plate supports 22*c* and 24*c*, where the baffle plates 22*b* and 24*b* are detachably fastened by fixing bolts 28.

As described herein, the exhaust gas inflow pipe 40 protrudes outside the muffle housing 10 through the front end cap 60. Therefore, according to the present invention, it is possible to prevent leakage of an exhaust gas by sealing (e.g., by taping) the area around the portion where the exhaust gas inflow pipe 40 passes through the front end cap 60 and it is easy to replace the exhaust gas inflow pipe 40 with another exhaust pipe, and connect the replacement exhaust pipe.

During assembly, the exhaust gas inflow pipe 40 is inserted in the muffler housing 10, extending to the rear chamber from the front chamber through the middle chamber. The exhaust gas inflow pipe 40 is fitted and supported through the front baffle 22 and the rear baffle 24. The exhaust gas outflow pipe 50 protrudes outside the muffle housing 10 through the rear end cap 60. Therefore, according to the present invention, it is possible to prevent leakage of an exhaust gas by sealing (e.g., by taping) the area around the portion where the exhaust gas outflow pipe 50 passes through the rear end cap 60 and it is easy to replace the exhaust gas intake pipe 40 with another exhaust pipe, and connect the replacement exhaust pipe.

The exhaust gas outflow pipe 50 is inserted in the muffler housing 10 through the rear end cap 60, extending to the front chamber from the rear chamber through the middle chamber. The exhaust gas outflow pipe 50 is fitted and supported through the front baffle 22 and the rear baffle 24. A plurality of connection holes 50*a* are formed at a portion of the exhaust gas outflow pipe 50, in particular, in the front chamber of the exhaust gas outflow pipe 50.

The connection pipe 30 extends from the front chamber to the rear chamber through the middle chamber. The connection pipe 30 is fitted and supported through the front baffle 22 and the rear baffle 24. A plurality of connection holes 30*a* are formed at a portion of the connection pipe 30, in particular, in the middle chamber of the connection pipe 30. A fixing ring 26*a* is fitted on the pipes and fixed by a fixing bolt such that the pipes can be fitted and stably fixed through the baffle plate supports 22*c*, respectively. An extension pipe 32 is connected to the connection pipe 34 by a connector 34, such that the length of the connection pipe 30 can be freely adjusted.

According to the present invention, an exhaust gas discharged from an engine flows into the rear chamber in the muffler housing 10 through the exhaust gas inflow pipe 40, where most of the exhaust gas flowing in the rear chamber flows into the front chamber through the connection pipe 30, and most of the exhaust gas flowing in the front chamber is discharged outside the muffler housing 10 through the exhaust gas outflow pipe 50, thereby reducing pressure, temperature, and noise while the exhaust gas flows through such a main exhaust path.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A muffler for a vehicle, comprising:

a muffler housing having a first housing body and a second housing body that are divided in two parts and form a predetermined-sized internal space with an inlet opening and an outlet opening when combined; and an internal structure inserted and forced into the internal space of the muffler housing to be detachable from the muffler housing, and allowing an exhaust gas discharged from an engine to flow into the internal space and to be discharged out of the muffler housing through a predetermined path, wherein the internal structure includes:

one or more baffles positioned within the internal space of the muffle housing and dividing the internal space into one or more chambers and an exhaust gas inflow pipe that allows the exhaust gas to flow into the internal space and is fitted through the baffles such that a position of the exhaust gas inflow pipe is adjustable;

an exhaust gas outflow pipe that allows the exhaust gas to flow out of the muffler housing from the internal space and is fitted through the baffles such that a position of the exhaust gas outflow pipe is adjustable; and a connection pipe that guides exhaust gas discharges into the internal space from the exhaust gas flow pipe to the exhaust gas outflow pipe and is fitted through the baffles such that a position of the connection pipe is adjustable.

2. The muffler of claim 1, wherein the baffles each include:

a baffle plate with one or more connection holes that allow adjacent chambers to communicate with each other; and a baffle plate support where the baffle plate is detachably fastened.

3. The muffler of claim 2, wherein the baffle plate support includes a fixing ring and a fixing bolt for fitting and fixing the exhaust gas inflow pipe, the exhaust gas outflow pipe, and the connection pipe.

4. The muffler of claim 1, wherein an extension pipe is connected to the connection pipe by a connector such that a length of the extension pipe is adjustable.

5. The muffler of claim 1, wherein the baffles include a front baffle and a rear baffle that divide the inside of the muffler housing into a front chamber, a middle chamber, and a rear chamber.

6. The muffler of claim 5, further comprising a front end cap and a rear end cap detachably mounted on the muffler housing to seal the muffler housing by closing an inlet opening and an outlet opening of the muffler housing.

7. The muffler of of claim 6, wherein the exhaust gas inlet opening pipe protrudes outward further than the front end cap, and the exhaust gas outflow pipe protrudes outward further than the rear end cap.

8. The muffler of claim 7, wherein the exhaust gas inflow pipe is fitted sequentially through the front end cap, the front baffle, and the rear baffle, and the exhaust gas outflow pipe is fitted sequentially through the rear end cap, the rear baffle, and the front baffle.

9. The muffler of claim 6, wherein the first housing body includes:

a first body panel curved with one or more continuous and stepped curvatures; and a first engaging flange protruding at both edges in the height direction of the first body panel, perpendicular to the first body panel, and having one or more fastening holes, and the second housing body includes:

a second body panel curved with one or more continuous and stepped curvatures; and a third engaging flange protruding at both edges in the height direction of the second body panel, perpendicular to the second body panel, having one or more fastening holes, and fastened to the first engaging flange in contact with the first engaging flange.

10. The muffler of claim 9, wherein the first housing body further includes a second engaging flange curved in the same shape as that of the first body panel at both edges in the longitudinal direction of the first body panel, and having one or more fastening holes, the second housing body further includes a fourth engaging flange curved in the same shape as that of the second body panel at both edges in the longitudinal direction of the second body panel, and having one or more fastening holes, and the front end cap and the rear end cap have cap flanges fastened to the second engaging flange and the fourth engaging flange, respectively.

11. The muffler of claim 10, wherein the first housing body further includes:

first guide protrusions longitudinally protruding from both ends of the second engaging flange, with a height smaller than the height of the first engaging flange from the bottoms of the ends, at the lower portion of the second engaging flange; and first engaging grooves having a cross-section due to the difference in height between the first guide protrusions and the fastening flange, and the second housing body includes:

second guide protrusions longitudinally protruding from both ends, with a height smaller than the height of the fourth engaging flange from the tops of the ends, and inserted in the first engaging grooves; and second engaging grooves that have a cross-section due to the difference in height between the second guide protrusions and the fourth engaging flange, under the second guide protrusions, and in which the first guide protrusions are inserted.

12. The muffler of claim 11, wherein the cross sections of the first and second engaging grooves may substantially be L-shaped.

13. The muffler of claim 11, wherein seating flanges longitudinally protruding outward further than the second engaging flange are formed at the first body panel, seating flanges protruding outward further than the fourth engaging flange are formed at the second body panel, and the front end cap and the rear end cap are fitted on the seating flanges.

14. The muffler of claim 12, wherein the ends of the first engaging flange are disposed inside the first engaging grooves to block one side of each of the first engaging grooves, and the ends of the third engaging flange are disposed inside the second engaging groove to block one side of each of the second engaging groove.

* * * * *